US011313191B2

(12) United States Patent
Hejleh

(10) Patent No.: US 11,313,191 B2
(45) Date of Patent: Apr. 26, 2022

(54) DOWNHOLE SURVEYING AND CORE SAMPLE ORIENTATION SYSTEMS, DEVICES AND METHODS

(71) Applicant: Globaltech Corporation Pty Ltd, Forrestfield (AU)

(72) Inventor: Khaled Mufid Yousef Hejleh, Peppermint Grove (AU)

(73) Assignee: Globaltech Corporation Pty Ltd, Forrestfield (AU)

( * ) Notice: Subject to any disclaimer, the term of this patent is extended or adjusted under 35 U.S.C. 154(b) by 224 days.

(21) Appl. No.: 15/562,890

(22) PCT Filed: Mar. 31, 2016

(86) PCT No.: PCT/AU2016/050241

§ 371 (c)(1),
(2) Date: Sep. 28, 2017

(87) PCT Pub. No.: WO2016/154677

PCT Pub. Date: Oct. 6, 2016

(65) Prior Publication Data

US 2018/0112483 A1 Apr. 26, 2018

(30) Foreign Application Priority Data

Mar. 31, 2015 (AU) ..... 2015901176

(51) Int. Cl.
*E21B 25/16* (2006.01)
*E21B 49/02* (2006.01)
*E21B 44/00* (2006.01)

(52) U.S. Cl.
CPC ..... *E21B 25/16* (2013.01); *E21B 44/00* (2013.01); *E21B 49/02* (2013.01)

(58) Field of Classification Search
CPC ..... E21B 25/16; E21B 44/00; E21B 49/02
See application file for complete search history.

(56) References Cited

U.S. PATENT DOCUMENTS 7,584,055 B2 9/2009 Parfitt
2007/0282533 A1* 12/2007 Parfitt ..... E21B 25/16 702/2

(Continued)

FOREIGN PATENT DOCUMENTS

AU 2008101021 A4 11/2008
AU 2008230012 A1 5/2009

(Continued)

OTHER PUBLICATIONS

International Search Report dated May 4, 2016 for PCT/AU2016/050241.

*Primary Examiner* — Steven A MacDonald
(74) *Attorney, Agent, or Firm* — Charles H Jew

(57) ABSTRACT

System and method for core sample orientating uses an orientation data gathering device recording core sample orientation belowground at irregular time intervals, preferably while drilling is ceased and the irregular time intervals can be randomly generated by the orientation data gathering device. Target orientation data is closest to time Tx, Tx being greater than, less than or equal to T−t, where T is the time recorded by the data gathering device and t is the recorded elapsed time commenced by a communication device at the surface. The data gathering device is interrogated at the surface by the communication device. Timers in each are stopped or their individual times associated with each other (survey time T and elapsed time t). Target recorded orientation data Tx is identifiable as the largest Tx value<T−(t−W), where W is a delay period.

33 Claims, 9 Drawing Sheets

(56) References Cited

U.S. PATENT DOCUMENTS

| | | | | |
|---|---|---|---|---|
| 2012/0018220 | A1* | 1/2012 | Parfitt | E21B 25/16 175/44 |
| 2012/0037421 | A1* | 2/2012 | Parfitt | E21B 47/024 175/44 |
| 2014/0008125 | A1* | 1/2014 | Hay | E21B 7/068 175/24 |
| 2015/0300162 | A1* | 10/2015 | Drenth | E21B 25/16 175/44 |

FOREIGN PATENT DOCUMENTS

| | | | |
|---|---|---|---|
| AU | 20100200162 | A1 | 2/2010 |
| WO | 2007137356 | A1 | 12/2007 |
| WO | 2013126955 | A1 | 9/2013 |

* cited by examiner

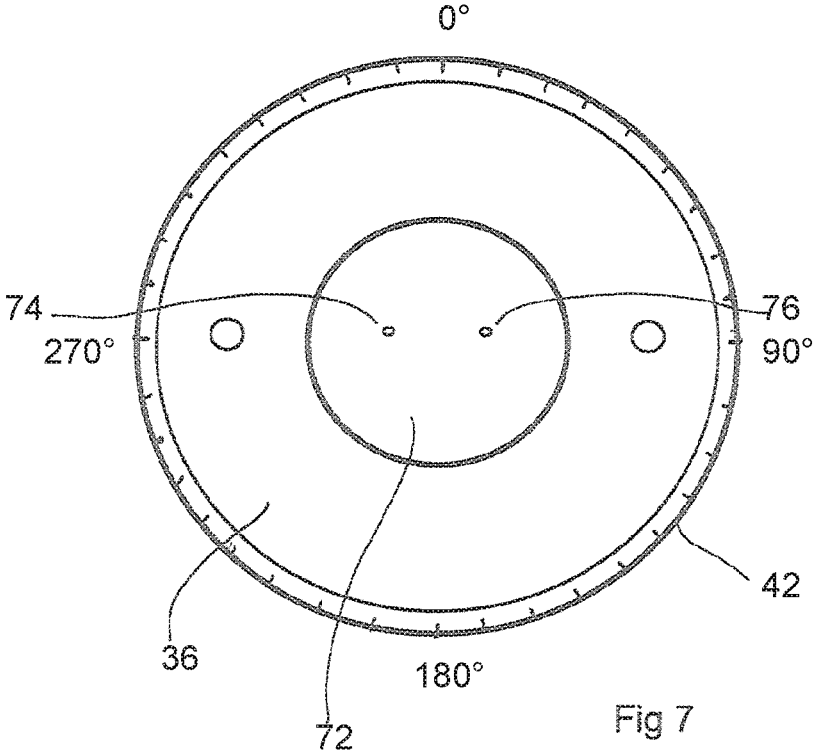
Fig 7
Fig 8a
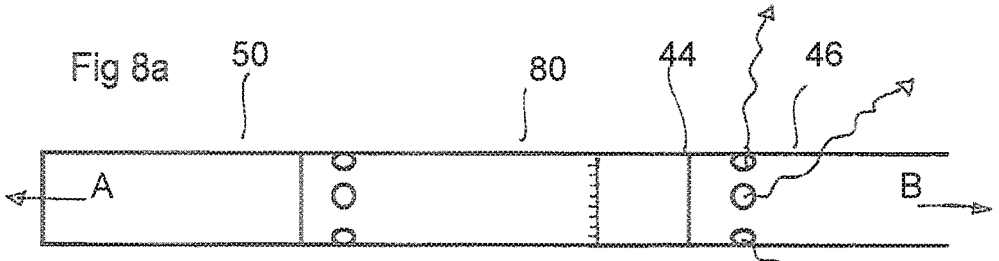
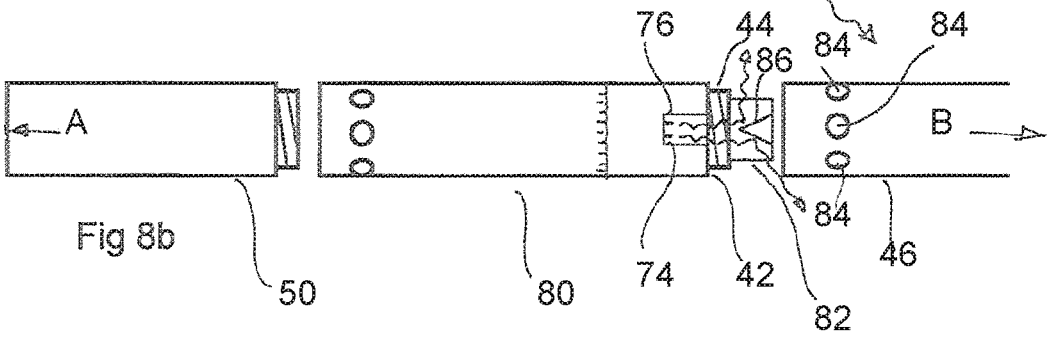
Fig 8b

In this example Tx = 4:30

In this example Tx = 5:05

In this example Tx = 4:24

DOWNHOLE SURVEYING AND CORE SAMPLE ORIENTATION SYSTEMS, DEVICES AND METHODS

FIELD OF THE INVENTION

The present invention relates to improvements to systems, devices and methods for conducting downhole surveying and/or for use in determining the orientation of a core sample relative to a body of material from which the core sample is obtained.

BACKGROUND TO THE INVENTION

Core orientation is the process of obtaining and marking the orientation of a core sample from a drilling operation.

The orientation of the sample is determined with regard to its original position in a body of material, such as rock or ore deposits underground.

Core orientation is recorded during drilling, and analysis is undertaken during core logging. The core logging process requires the use of systems to measure the angles of the geological features, such as an integrated core logging system.

Whilst depth and azimuth are used as important indicators of core position, they are generally inadequate on their own to determine the original position and attitude of subsurface geological features.

Core orientation i.e. which side of the core was facing the bottom (or top) of a borehole and rotational orientation compared to surrounding material, enables such details to be determined.

Through core orientation, it is possible to understand the geology of a subsurface region and from that make strategic decisions on future mining or drilling operations, such as economic feasibility, predicted ore body volume, and layout planning.

In the construction industry, core orientation can reveal geological features that may affect siting or structural foundations for buildings.

Core samples are cylindrical in shape, typically around 3 metres long, and are obtained by drilling with an annular hollow core drill into subsurface material, such as sediment and rock, and recovering the core sample.

A diamond tipped drill bit is often used and is fitted at the end of the hollow drill string. As the drill bit progresses deeper, more sections of hollow steel drill tube are added to extend the drill string.

An inner tube assembly captures the core sample. This inner tube assembly remains stationary while the outer tubes rotate with the drill bit. Thus, the core sample is pushed into the inner tube.

A 'back end' assembly connects to a greaser. This greater lubricates the back end assembly which rotates with the outer casing while the greater remains stationary with the inner tubing.

Once a core sample is cut, the inner tube assembly is recovered by winching to the surface. After removal of the back end assembly from the inner tube assembly, the core sample is recovered and catalogued for analysis.

Various core orientation systems have previously been used or proposed. For example, early systems use a spear and clay impression arrangement. A spear is thrown down the drill string and makes an impression in clay material at an upper end of the core sample. This impression can be used to vindicate the orientation of the core at the time and position the spear impacted the clay.

A more recent system of determining core orientation is proposed in Australian patent number AU 2010200162. This patent describes a system requiring a device at the surface and a separate downhole core orientation tool. Each of the device and downhole tool has a timer. Both timers are started at a reference time. The downhole tool records measurements relating to orientation of the tool at regular predetermined time intervals.

According to AU 2010200162, a 'mark' is taken when drilling is ceased and the core sample is ready to be separated from the underlying rock. This 'mark' is recorded by the device at the surface as a specific time from the reference time. The core sample is then separated from the rock and the downhole tool is returned to the surface with core sample in an attached core tube. The device retained at the surface then interrogates the returned downhole tool to identify the measured orientation data that was recorded closest to the end of the specific time i.e. presumably when drilling was ceased and the core sample and downhole tool have not rotated relative to one another prior to breaking the core sample from the rock.

Thus, AU 2010200162 looks forward in time the specific amount of time from the reference time commenced at the surface. Both timers, the one at the surface and the one downhole, have to count time at exactly the same rate from the commenced reference time i.e. the two timers are synchronised. Furthermore, the downhole tool takes measurements at regular predetermined intervals, many measured values being unusable because they are recorded whilst drilling is underway, resulting in there being no reliable rotational position relationship between the downhole tool and the core sample being drilled, since vibration from drilling causes variation in their rotational relationship and therefore discrepancies between measurements.

In addition, because AU 2010200162 takes measurements at predetermined regular time intervals, on-board battery power is wasted obtaining unusable measurements.

Thus, AU 2010200162 takes measurements determined by an on-board timer whether or not the values obtained are worthwhile or accurate. This leads a large amount of unusable data which is typically discarded and such continuous or too often recording of data unnecessarily rapidly reduces battery life of the downhole device. Such known arrangements may only last a few weeks or months before the downhole device needs recharging or replacing. Often spare equipment is held on hand just in case the batter fails. This leads to far too much equipment being needed, at an increased cost to the drilling operator. It would be beneficial to reduce reliance on holding spare equipment on hand.

In addition, it has been realised that, during the drilling process, if sections of fragmented earth are drilled into (resulting in fractured core samples) then the inner tube can rotate. Furthermore, vibrations caused by drilling have also been identified as a cause of inaccurate data.

Also, it has been realised that only a limited amount of downhole data is actually required in order to later determine correct orientation of a core sample at the surface. It has been realised that data recording on a continuous or frequent periodic basis whilst drilling is occurring is unnecessary. Only down orientation of the core sample needs to be known, and provided data relating to the down orientation can be identified and referenced to a particular known time, core orientation can be determined.

Another downhole tool is described in Australian patent number AU2008229644, which tool requires a downhole event to be detected by a trigger system so that the trigger system consequently triggers the tool to record a position measurement. The trigger system has to detect a downhole event before the tool will record the position indication.

It has therefore been found desirable to provide improved downhole data recording through a system, device and/or method that alleviates one or more of the aforementioned problems whilst facilitating more reliable data recovery.

SUMMARY OF THE INVENTION

With the aforementioned in view, at least one form of the present invention provides a method of obtaining orientation data for a rock core sample obtained by drilling, the method including:

advancing a data gathering device into the borehole, the data gathering device having timer, the timer commencing a recorded time period before the core sample is separated from the rock, ceasing drilling;

the data gathering device recording orientation data while the drilling is ceased and before the core is separated from rock to which it is attached, commencing an elapsed time at the surface;

separating the core sample from the rock;

returning the core sample and the data gathering device to the surface, at the surface, subtracting the elapsed time from the recorded time period of the data gathering device, obtaining from the data gathering device the recorded orientation data while the drilling was ceased and obtained before or after the commencement of the elapsed period of time and before the core sample was separated from the rock.

A further aspect of the present invention provides a method of obtaining orientation data for a rock core sample obtained by drilling, the method including:

advancing a data gathering device into the borehole, the data gathering device having timer, the timer commencing a time period before the core sample is separated from the rock, ceasing drilling;

the data gathering device recording orientation data while the drilling is ceased, commencing an elapsed time at the surface;

separating the core sample from the rock before or after commencing the elapsed time;

returning the core sample and the data gathering device to the surface;

stopping the elapsed time and the time period recorded by the data gathering device;

determining back the elapsed time from the recorded said time period of the data gathering device, obtaining from the data gathering device the recorded orientation data while the drilling was ceased and obtained before or after the commencement of the elapsed period of time and before or after the core sample was separated from the rock.

Preferably the data gathering device records orientation data at random or regular time intervals.

More preferably the data gathering device records orientation data at the random time intervals, such as time intervals selected at random from a predetermined range of time intervals.

The random time intervals may be determined by a random number generator determining each time interval from a range within a maximum time period and a minimum time period.

The minimum time period may be 1 second, and the maximum time period may be, for example, 60 seconds. Preferably the random time intervals are selected from periods of 10 second multiples e.g. 10 s, 20 s, 30 s etc.

Preferably the recorded orientation data sought is that recorded data obtained while drilling was ceased and after commencement of the elapsed time but before the core was separated from the rock.

Preferably the orientation data sought is that data recorded most immediate after commencement of the elapsed time.

A wait time may commence with or after commencement of the elapsed time. The wait time can ensure or allow sufficient time for recordal of required orientation data and the wait time being subtracted from the elapsed when identifying the required orientation data.

Preferably the recorded orientation data sought is that recorded data obtained while drilling was ceased and before commencement of the elapsed time but before the core was separated from the rock.

Preferably the orientation data sought is that data recorded most immediate before commencement of the elapsed time.

A wait time may commence prior to commencing the elapsed time, the wait time ensuring recordal of required orientation data.

Preferably the recorded orientation data sought is that recorded data most recent before or after commencement of the elapsed time and before the core was broken from the rock.

A wait time may be commenced after breaking the core before commencing the elapsed time. The wait time may ensure or allow recordal of post core separation orientation data, and the required orientation data being orientation data recorded before the post core orientation data but while drilling was ceased.

For example, when a 'mark' is taken at the surface which commences the elapsed time, there may be a delay allowing recordal of orientation data while drilling is still ceased and before the core sample is separated from the underlying rock, yet whilst the elapsed time has commenced.

Consequently, once retrieved to the surface, the data gathering device can be interrogated to identify the recorded orientation data by 'looking back' the elapsed period of time, and then identifying the recorded data before or after commencement of the elapsed time but whilst the core was still attached to the rock. This may be achieved by delaying actuation of core breaking a period of time sufficient for the data gathering device to record orientation data after the elapsed time commences. For example, waiting a period of 10 mins after ceasing drilling and commencing the elapsed time period, and when the data gathering device records orientation data before the end of the 10 min period.

Preferably the data gathering device includes processing means which determines from the received elapsed time value at the surface the newest recorded orientation data that was obtained by the data gathering device during the survey time after subtracting the elapsed time value from the survey time.

Thus, the time period counted by the data gathering device may be termed the survey period or survey time i.e. the time from commencement of the period of time counted by the data gathering device at or delayed after deployment thereof.

The data gathering device's timer preferably providing a timestamp for recorded orientation data events.

Also, and of great benefit, the data gathering device can 'go to sleep' in a standby mode while drilling is occurring and no data is being collected. This greatly enhances battery life in the data gathering device. By only waking to take sampling shots when no vibration is detected or only commencing taking data shots, one or more embodiments of the present invention greatly increases battery life in the data gathering device.

The communication device may use an internal clock or timer to 'mark' or identify a user input. For example, the user input may commence a timing period of an internal clock or timer.

The input to the communication device, such as a user operating one or more buttons or touch screen controls, on the communication device may include one or more of; an indication of a most recent occurrence when drilling ceased; an indication immediately prior to separating the core sample from the subsurface body and/or an indication after separating the core sample from the subsurface body.

The communication device may be used to activate/deactivate the data gathering device, such as to cease gathering data.

The data gathering device may be used to provide survey data to the communication device or another receiver, the survey data being or derived from recorded data obtained when the no vibration had been detected.

The data gathering device may be operated to provide to the communication device survey data relating to recorded data obtained prior to a defined elapsed period of time.

The defined elapsed period of time may be provided to the retrieved data gathering device from the communication device.

The defined elapsed period of time may be used by the data gathering device to identify recorded data obtained during surveying at a time prior to the amount of the defined time.

Identified recorded data provided as survey data to the communication device or other receiver may be from recorded data recorded by the data gathering device at a period in time closest to the time prior to the amount of defined time than any other recorded data event.

The data gathering device may be operated to detect that vibration is occurring and to therefore wait until a subsequent no vibration event occurs before recording data.

The data gathering device may be employed to detect multiple consecutive survey values during a period of no vibration.

Acceptable recorded data may be identified with a timestamp relating to real time.

A further aspect of the present invention provides a system for use in determining orientation of a core sample obtained by drilling from aboveground into a subsurface body, the system including a data gathering device arranged and configured with control means to detect when vibration from drilling is below a threshold, and activation means to cause the data gathering device to record data during the period of vibration below the threshold.

Downhole survey equipment that 'goes to sleep' when it would otherwise record data that is unnecessary to collect or not worthwhile collecting because of inaccuracies greatly saves on battery power and therefore lengthens the life of the downhole device before the battery needs replacing or recharging.

This means that high value (cost and functional value) equipment can remain in use in the field when known equipment would otherwise need replacing. This can avoid the need to hold multiple pieces of battery powered survey equipment on hand just in case one loses power.

Preferably the threshold it set at no vibration from drilling.

Vibration from drilling results from the drill bit cutting into the subsurface body to advance the drill string and from rotation of the drillstring tube.

The data gathering device including a timer providing a timestamp for recorded data events.

One or more forms or embodiments of the present invention provides or includes a method whereby, when drilling is ceased/stopped; the data gathering device records core orientation data; the core is subsequently separated from its connection with the ground; the communication device signals to the data gathering device to identify the recorded core orientation data that was immediately prior to separating the core sample from the ground; and using that recorded core orientation data to identify orientation of the core sample.

A communication device as part of the system includes communication means arranged and configured to communicate a time value to the data gathering device, the data gathering device including processing means which determines from the received time value the closest recorded data obtained immediately prior to a time determined by subtracting the received time value from a current time value.

The current time value (preferably a real time value or a time quantity) may be provided by the communication device to the data gathering device.

A further aspect of the present invention provides a system for use in determining orientation of a core sample obtained by drilling from aboveground into a subsurface body, the system including:

a data gathering device to record data downhole relating to orientation of the core sample, the data gathering device recording the data when drilling has ceased, and the data gathering device including a timer providing a survey time, and the system including a communication device and a timer at the surface, the timer providing an elapsed time value when the data gathering device is retrieved to the surface, the elapsed time commenced when drilling has ceased and before the core is separated from the rock, and the data gathering device including processing means which determines from the received elapsed time value the recorded orientation data that was obtained by the data gathering device during the survey time after subtracting the elapsed time value from the survey time.

The data gathering device's timer can include a timestamp means for time-stamping recorded data events. Preferably the time stamp is a real time derived from a real time timer.

The data gathering device may record the orientation data at randomly generated time intervals to be within predetermined maximum and minimum time interval limits.

The data gathering device's timer can have a delay means to provide a delay to commence timing after the data gathering device is deployed downhole.

The timing commencement delay may be provided by a preset means which provides a preset in the data gathering device, preferably by communication from the communication device.

An alternative aspect of the present invention provides a method of obtaining downhole survey data in a borehole created by drilling, the method including advancing a data gathering device into the borehole, the data gathering device determining that vibration is below a predetermined threshold, bringing the data gathering device out of a standby mode during a period when vibration is determined to be below the threshold, recording data during the period, returning the data gathering device to a standby mode when vibration is determined to be above the threshold or sufficient said data has recorded.

Thus, a preferred concept of reducing power consumption in downhole survey tools is realised. A standby, or low power mode, reduces power consumption to a minimum while vibration is detected to be above a threshold limit.

An alternative aspect of the present invention provides a method of determining selection of downhole survey or core orientation data of a respective downhole survey or core orientation device, the method including; a) providing a data recorder, the recorder arranged to record data relating to downhole surveying or core sample orientation; b) providing a communication device remote from the data recorder, the communication device having a timer and remaining at a ground surface when the data recorder is below ground; c) commencing timing with the timer; d) operating the data recorder to record one or more data events whilst downhole; e) subsequent to communication device commencing the timing, signalling to the data recorder to provide or identify a recorded data event, the recorded data event being determined by the communication device to be a predetermined period of time prior to the signalling to the data recorder.

Thus, the communication device, which may also be termed a communication device, and the data recorder, which may also be termed a data gathering device, are not time synchronised to each other, and yet the data recorder can be interrogated to provide a required data set or record from a set period time prior to being signalled.

For example, the communication device, with its own timer running, may be used to 'mark' a specific moment. At this stage, the data recorder has its own timer running, unsynchronised to the timer of the data recorder.

An elapsed period of time after the 'mark' is recorded, the communication device signals to the data recorder (data gathering device) to identify or note a data set or record previously recorded a set period of time ago. The data recorder then checks its memory for the recorded data set or record closest to the end of the set period of time that the communication device has signalled to the data recorder to look back.

A further aspect the present invention provides a core sample orientation system configured to provide an indication of the orientation of a core sample relative to a body of material from which the core has been recovered, the system including a hermetically sealed core sample orientation data gathering device deployable as part of a downhole core sample assembly.

Communication means may be arranged to communicate obtained core sample orientation data to a remote orientation data indication display device having an orientation data display.

A further aspect of the present invention provides a hermetically sealed core sample orientation data gathering device when deployed as part of a core sample orientation system for providing an indication of the orientation of a core sample relative to a body of material from which the core has been extracted.

The orientation data gathering device may include communication means for providing core sample orientation data to a remote orientation data electronic device having an orientation data display.

Thus, the orientation data gathering device of the present system being hermetically sealed avoids risk of ingress of liquid when the downhole, thereby leading to more reliable data gathering operations without the need to recover the device prematurely in order to repair or replace a faulty device, or risk completing a core sampling operation but find at the surface that no data can be recovered and the core orientation cannot be accurately determined.

The orientation data gathering device may be connected to a standard greater unit, thereby allowing known equipment to be used and avoiding the need for specialised greater to be adopted.

Because the orientation data gathering device is hermetically sealed to ensure no liquid gets in to the device when deployed downhole, and the device has communication means to send data signals to a remote display, no o-ring seal to the greater is required. This saves on unreliable o-ring seals, reduces risk of damage through water ingress and loss of data, as well as the time saved in not having to recover the damaged device and redeploy a replacement.

The system may further include timer means to commence multiple time intervals for the device to obtain orientation data.

The orientation data gathering device may have one or more visual indicators to show an operator one or more required directions of rotation of a recovered core sample assembly for determining orientation of the core sample, and once a required core sample orientation has been established, the remote orientation data electronic communication device may interrogate the orientation data gathering device to obtain orientation data.

Communication between the orientation data gathering device and the remote orientation data electronic communication device is by wireless communication, such as infra red communication.

The remote orientation data electronic communication device may include a display to show visual information relating to the obtained orientation data, such as an indication that sufficient data has been obtained, that the data is correctly and safely stored and/or that data has been transferred from the orientation data gathering device to the remote orientation data electronic communication device.

The orientation data gathering device may include one or more visual and/or audible indicators relating to a direction of rotation of the device when determining core sample orientation and/or when a required core sample orientation has been determined.

For example, illuminated indicators may be provided on the device, such as on an end of the exposed when the greater is removed. However, the greater does not have to be removed, as the light can actually be seen through the existing holes in an off the shelf greaser.

A particular colour, number of lights or direction indication may illuminate to indicate that the device and the core sample need rotating in one direction, and a different colour, number of lights or direction indication may illuminate to show an opposite rotation direction is needed. These may be augmented by or replaced by audible indications, such as respective numbers of 'bleeps'.

An illuminated and/or audible indication may be given when a required core sample orientation is achieved. For example, both direction lights or audible signals may be given at the same time.

The remote orientation data communication device may also give an indication of the required direction of rotation and/or required core sample orientation.

The remote orientation data communication device may include or be a handheld unit. This unit may include a battery for power, which may be a rechargeable battery.

A further aspect of the present invention provides a method of obtaining core sample orientation data, the method including: deploying a core sample orientation data gathering device as part of a core sample gathering system; obtaining a core sample from a subsurface body of material using the apparatus; using the orientation data gathering device to determine the orientation of the core sample relative to the subsurface body of material; and using a remote communication device to obtain from said orientation data gathering device data relating to the orientation of the core sample.

The method may further include hermetically sealing the core sample orientation data gathering device prior to deployment.

Following recovery of the device, core orientation indications may be given by one or more illuminated and/or audible indications. Coloured indications may be used to determine a required orientation of the core sample.

For example, the orientation data gathering device may include lights, such as LEDs, whereby an indication is given to rotate the core sample in a first direction or in a second opposite direction to obtain a required core sample orientation position, or lights may be used to indicate when a required orientation position has been obtained.

The method may include deploying the orientation data gathering device leading a greaser. The greater device may preferably be a standard greaser.

Multiple time intervals may be measured by the device. These time intervals can be used to determine data gathering events, such as position, magnetic flux, gravity, velocity, acceleration etc. A time interval can be synchronised to a specific downhole data gathering event.

Data may be obtained from the orientation data gathering device by communication with a remote device, such as by an infra red link or other wireless communication, such as radio link, between the orientation data gathering device and an orientation data communication device.

A data gathering device according to one or more forms of the present invention preferably does not continuously take 'core orientation' readings while in use. Instead, such a device preferably determines when the device is 'motionless' (through its in-built firmware algorithms and sensors) before taking orientation readings. This arrangement of orientation recording confirms that the device only records valid data, i.e. while motionless, as the in-built sensors would otherwise present faulty or indeterminate readings.

Alternatively, the data gathering device can, as described above, record orientation related data based on random time intervals within a minimum and maximum range of time values.

If an operator erroneously selects a time interval for 'core orientation' (via the handheld unit while the data gathering device is still in motion), after retrieving the core sample, algorithms programmed into the device will determine the 'best-approximate' time interval relative to the device being 'steady' or 'motionless' at a time before or after a time selection by the operator using a hand held unit to communicate with the device as part of an embodiment of the system. The event and time difference will also be reported to the operator to confirm acceptance of that recorded data.

After core retrieval, the data gathering device provides an indication, using one or more light emitting diodes (LEDs), used to determine correct orientation of the core sample after rotating the device and core tube assembly in either direction (no indication of left or right direction is required). The LEDs do not necessarily indicate direction, but provides 'multi-level-speed' LED flashing rates, followed by a steady ON state LED illumination to determine correct core orientation. One or more other systems using various colours and flash rates, etc could be employed.

According to one or more embodiments of the present invention, before inserting the down-hole data gathering device into a drill hole, and after retrieving the same unit with the obtained core sample, the wireless handheld unit can start/stop or interrogate the down-hole device without having to remove or unscrew the unit from the drill-string or core tube sections. The handheld unit does not need to be attached, screwed in, mounted to or wedged to any part of the tubing or GCOU assembly during any operation).

Start/stop operations, setting the exact time for orientation, interrogating and recording 'confirmed-accurate' operator orientation procedure, may all be performed using a remote wireless hand-held unit communicating with the data gathering device unit that was down the drill hole.

Visual indication of core sample orientation may be provided through at least one aperture in a sidewall of a section of a downhole assembly. Core sample orientation indications may be as light through at least one aperture in the sidewall of a section of the downhole assembly, such as a greater unit. Core sample orientation visual indications may be provided from one or more light emitters via at least one light reflector, and preferably reflecting that emitted light out through the at least one aperture.

One or more embodiments of the present invention will hereinafter be described with reference to the accompanying figures.

BRIEF DESCRIPTION OF THE DRAWINGS

FIG. 7 shows an indicator window end of a core sample orientation device according to an embodiment of the present invention where-through indicator lights can show when illuminated.

FIGS. 8*a* and 8*b* show an alternative embodiment of a data gathering device of the present invention.

DESCRIPTION OF PREFERRED EMBODIMENT

Figure 1:
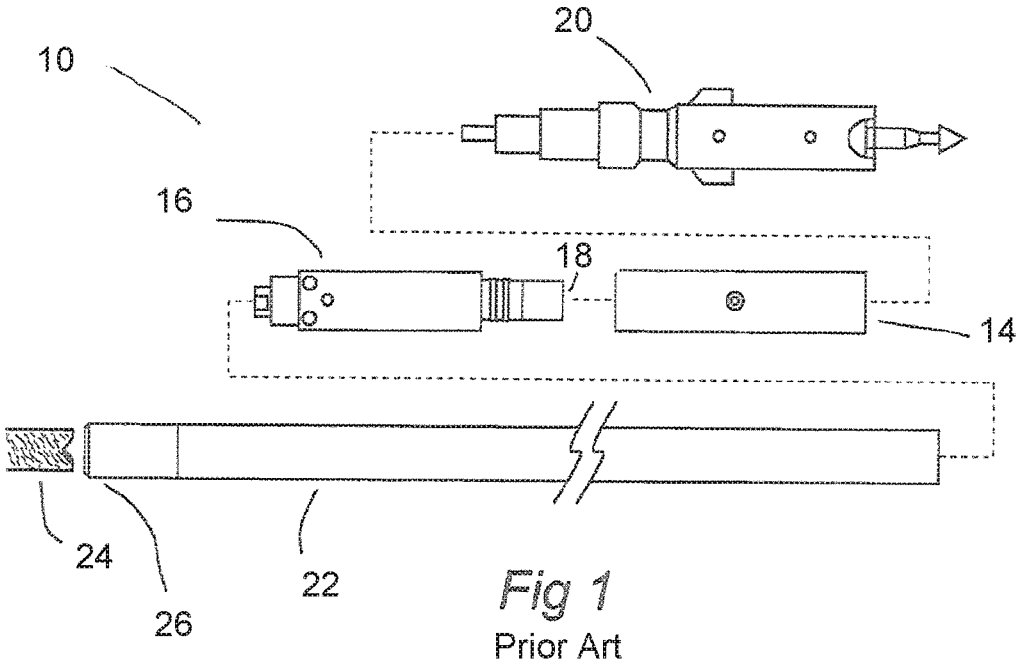
Fig 1 Prior Art
FIGS. 1 and 2 show features of a known core sample orientation system.
Figure 2:
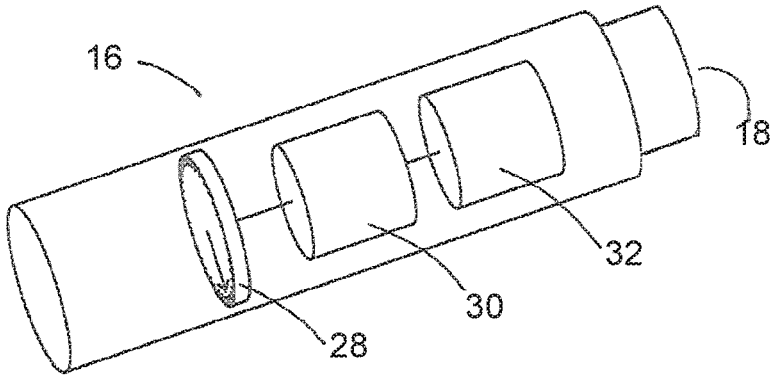
Fig 2 Prior Art
Figure 3:
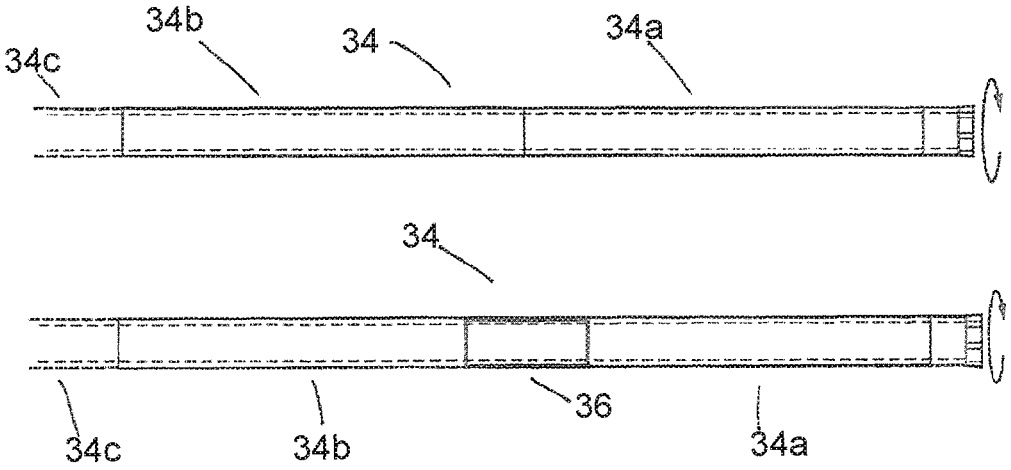
Fig 3 Prior Art
FIGS. 3 and 4 show features of an arrangement of a core sample orientation system according to an embodiment of the present invention.
Figure 4:
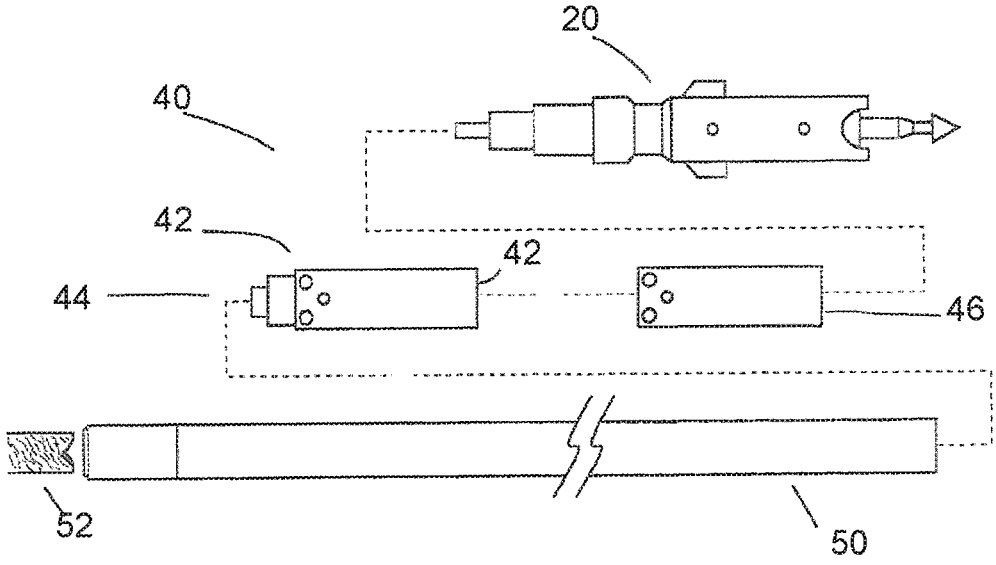
Fig 4 Prior Art

In FIGS. 1 and 2, a known prior art inner tube assembly 10 replaces a standard greater with a two unit system 14,16 utilising a specialised greater unit 14 and electronics unit 16 particular to the two unit system. The electronics unit is sealed to the greater unit by o-rings, which have a tendency to fail in use and allow liquid into the electronics unit, risking loss of data and/or display failure.

The electronics unit has an LCD display 18 at one end. This allows for setting up of the system prior to deployment and to indicate visually alignment of the core sample when retrieved to the surface. The greater unit is connected to a backend assembly 20 and the electronics unit 16 is connected to a sample tube 22 for receiving a core sample 24.

The electronics unit is arranged to record orientation data every few seconds during core sampling. The start time is synchronised with actual time. The units are then lowered into the drill string outer casing to commence core sampling.

After drilling and capturing a core sample in the inner core sample tube, the operator stops the stop watch and retrieves the core sample tube back to the surface.

At the surface, before removing the core sample from the inner tube, the operator views the LCD display 18, if it is still working, which steps the operator through instructions to rotate the core tube 22 until the core sample 24 lower section is at the core tube lower end 26. The core sample is then marked and stored for future analysis.

Referring to FIG. 2, the known electronics unit 16 of FIG. 1 includes accelerometers 28, a memory 30, a timer 32 and the aforementioned display 18.

The system 40 according to an embodiment of the present invention will hereinafter be described with reference to FIGS. 3 to 6.

An outer drilling tube 34 consisting of connectable hollow steel tubes 34*a-n* has an extension piece 36 connected inline between two adjacent tubes in order to compensate the length of the outer drilling tube in relation to the additional length gained by the inner tube assembly 40 due to the core sample orientation data gathering device 42.

The core sample orientation data gathering device 42 is a fully sealed cylindrical unit with screw threads at either end. A first end 44 connects to a standard length and size greater unit 46 and a second end 48 connects to a core sample tube 50. The greater unit connects to a standard backend assembly 20.

There are no LCD display panels, indicators or switches mounted on the device. LED indicators are provided at one end 44, the greater end, that are used in determining correct orientation of the core sample once the core and the device are recovered back a the surface. FIG. 7 shows an example of the indicator end 44 of the core sample orientation data gathering device 42.

Figure 5:
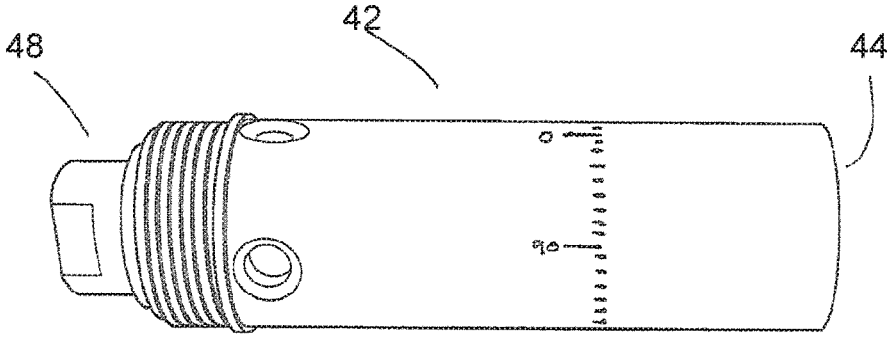
FIG. 5 shows a core sample orientation data gathering device according to an embodiment of the present invention.

In FIG. 5, the core sample orientation data gathering device 42 is shown in close up. The end 44 for connecting to the greater unit 46 includes a window (not shown in FIG. 5—see FIG. 7). One or more LED lights are provided sealed within the device 42 behind the window. A coloured light indication is given to indicate which way (clockwise or anti-clockwise) the device 42 must be rotated to obtain a desired orientation of the core sample still within the inner tube assembly that is connected to the core sample orientation data gathering device 42.

For example, a red light may be given to indicate to rotate the device (and thus the core sample) anticlockwise or to the left, and a green light may be given to indicate to rotate the device clockwise or to the right. A combined red and green indication, or a white light indication, or other indication can be given, such as flashing lights, to indicate that the core sample is correctly orientated and ready for marking. For example, the rotate left and rotate right indications may be given by left and right hand lights flashing more rapidly or more slowly when the device is rotated towards the correct orientation e.g. faster flashing lights as the correct roll orientation is approached can become continuous when the correct orientation is reached, or slower flashing lights can become extinguished or continuous when the correct roll orientation is reached.

It will be appreciated that the data gathering device can either communicate a correct roll orientation to the communication device or can self display the correct orientation, or can transmit the orientation data to another device for displaying the correct orientation, or combinations thereof.

Figure 6:
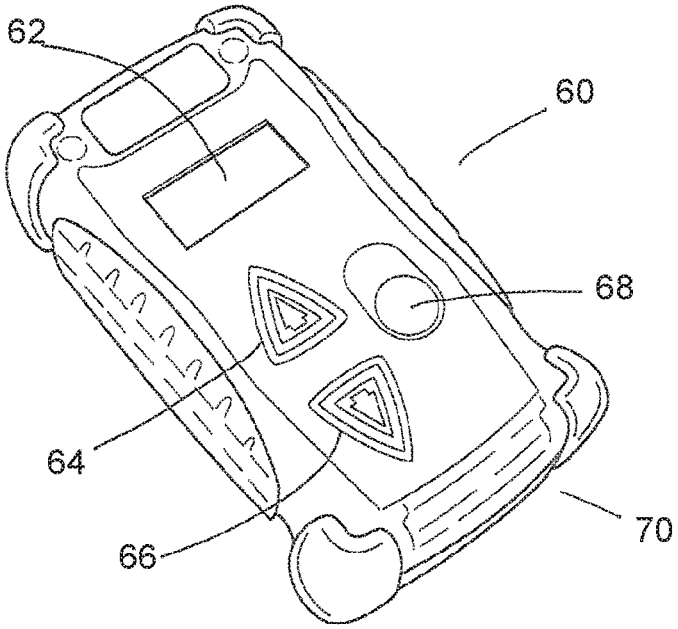
FIG. 6 shows a hand held device for interrogating the core sample orientation data gathering device according to an embodiment of the present invention.

FIG. 6 shows an embodiment of the hand held device 60 which receives wirelessly receives data or signals from the core sample orientation data gathering device 42.

The core sample orientation data gathering device 42 includes a transmitter which can use line of sight data transfer through the window, such as by infra red data transfer, or a wireless radio transmission. The communication device 60 can store the signals or data received from the core sample orientation data gathering device 42. The communication device 60 includes a display 62 and navigation buttons 64, 66, and a data accept/confirmation button 68. Also, the hand held device is protected from impact or heavy use by a shock and water resistant coating or casing 70 incorporating protective corners of a rubberised material.

Setting up of the device is carried out before insertion into the drill hole. Data retrieval from the data gathering device 42 is carried out by infra red communication between the core sample orientation data gathering device 42 and a core orientation data receiver (see FIG. 6) or communication device 60.

After recovering the core sample inner tube back at the surface, and before removing the core sample from the tube, the operator removes the 'back end assembly, and the attached greater unit.

The operator then uses the remote communication device to obtain orientation data from the core sample orientation data gathering device using an line of sight wireless infra red communication between the remote device and the core sample orientation data gathering device.

However, it will be appreciated that communication of data between the core sample orientation data gathering device 42 and the communication device 60 may be by other wireless means, such as by radio transmission.

The whole inner tube 50, core sample 52 and core sample orientation data gathering device 42 are rotated as necessary to determine a required orientation of the core sample.

The indicators on the greater end of the core sample orientation data gathering device 42 indicate to the operator which direction, clockwise or anti-clockwise, to rotate the core sample. One colour of indicator is used to indicate clockwise rotation and another colour to indicate anti-clockwise rotation is required. This is carried out until the core sample is orientated with its lower section at the lower end of the tube. The core sample is then marked for correct orientation and then used for analysis.

As shown in FIG. 7, the indicator window end 44 of the core sample orientation data gathering device 42 includes a window 72. The indicator lights can be seen through this window at least when illuminated. In this embodiment, two lights, red and green LEDs are shown. The left hand 74 (red) LED illuminates to indicate to a user to rotate the device 42 anti-clockwise. The right hand 76 (green) LED illuminates to indicate to a user to rotate the device 42 anti-clockwise.

When correct core sample orientation is achieved, both LEDs might illuminate, such as steady or flashing red and green, or another illuminated indication might be given, such as a white light (steady or flashing).

The visual and/or audible indicators, under certain site and/or environmental conditions, may not be sufficiently visible or audible. They may be hard to see in bright light conditions or hard to hear in loud working environments. Thus, an additional or alternative means and/or method may be utilised to ensure that the core sample has been correctly orientated.

The outer casing or body or an end of the core sample data gathering device 42 may have angular degree marks. These are optional. These may be scribed, etched, machined, moulded or otherwise provided, such as by printing or painting, on the device 42.

For example, as shown in FIG. 7 dashes equally spaced around the outside parameter (each representing one or more angular degrees of the full circle or perimeter). Further scribing of a number every five dashes starting with the number "0" then 5, 10, 15 etc. until 355.

However, it will be appreciated that the angular degree markings need not be present. The data gathering device of one or more embodiments of the present invention need not be calibrated to 'know' which angular degree value or values relates to an cup' (or the top) or 'down' (or the bottom) direction of the device and therefore of the core sample.

The data gathering device can associate a recorded data with a detected cup' or 'down' direction, and therefore, when the device is retrieved to the surface, and the data gathering device is interrogated, it can identify the recorded orientation data relevant to the required cup' or 'down' direction. No calibration is needed. The data gathering device preferably remembers its roll orientation and which direction was up oe down when that was recorded. Thus, only the correct orientation need be recorded and used at the surface when acquiring the orientation indication.

When the core is retrieved and the orientation device communicates with the hand held communicator 60, additional information is transmitted from the orientation device to the communicator 60, such as a number between Zero and 359 (inclusive) denoting an angular degree of rotation of the core sample orientation data gathering device and the core sample.

When the core is oriented during one or more embodiments of the method of the present invention, scribing on the core sample orientation data gathering device 42 number on the top side should be the same as the number transmitted to the communicator 60, which re-confirms correct orientation.

Thus, if the visual or audible means for indicating core orientation are not useful or available, then the core is oriented using the angular degree arrangement (top side) to match the number transmitted, and then this would be audited using the communicator 60 as is the case now.

The core sample orientation data gathering device of the present invention is hermetically sealed against ingress of water or other liquids, even at operative borehole depths and conditions.

No additional or alternative sealing, such as separate o-ring seals between the greater and core sample orientation data gathering device or between the inner core tube and the core sample orientation data gathering device are required. Thus, maintenance or risk of ingress of liquid is not of concern.

The greater does not need to be separated from the core sample orientation data gathering device in order to communicate with the device to obtain core orientation data.

Likewise, setup prior to deployment is improved in terms of time and ease of use by not requiring a specialised back end assembly, rather, a standard greater and back end assembly is used. This also improves compatibility with standard systems.

Obtaining core orientation is made easier by only requiring two colours lights to indicate one or other direction of rotation to establish correct core orientation prior to marking.

The indicators form part of the sealed device and can be low power consumption LED lights. Alternatively, flashing lights may be used.

For example, a certain frequency or number of flashes for one direction and another frequency or number of flashes for the other direction of rotation. A steady light could be given when correct orientation is achieved.

Confirmed correct core alignment is registered in the remote communication device 60. This provides for an audit trail, and the data can be readily transferred to computer for analysis and manipulation. This also provides reassurance of accuracy of sampling and orientation to operators, geologists and exploration/mining/construction companies.

In use, the core inner tube 50, data gathering device 42 and greater 46 are connected together in that order and lowered into a core sampling outer tube having an annular diamond drill bit at the furthest end.

Once a core sample is obtained, the inner tube assembly with the data gathering device and greater are recovered back to the surface, the back end assembly 20 and greater can be removed but do not need to be. The communication device can put the data gathering device into an orientation mode whilst the data gathering device is still connected to the greaser.

Using an infra red link or other wireless link, the data gathering device is put into orientation indicating mode by the remote communication device 60. The core sample and data gathering device are then rotated either clockwise or anti clockwise to establish a required orientation position.

The remote communication device is then used to communicate with the data gathering device to obtain core sample orientation data from the data gathering device.

No LCD or other display is needed on the data gathering device that might otherwise risk leakage in use and ingress of liquid or failure of the display due to display power demands on the limited battery life or display failure due to the harsh environment downhole.

The required orientation of the core sample is then marked and the core sample can be stored and used for future analysis. The received data can be transferred to a computer for analysis.

According to an alternative embodiment of the present invention shown in FIGS. 8*a* and 8*b*, a data gathering device 80 houses the light emitters 74,76. Light from these emitters (e.g. LEDs) passes through the window 72 (shown in FIG. 7) and out through one or more apertures in the side wall of the data gathering device.

The at least one aperture in the side wall can be at the grease cap end of the data gathering device or be in the side wall at the opposite end of the data gathering device.

Reference arrow A refers to the drill bit end direction, and reference arrow B refers to the backend assembly direction. An optical adapter 82 is provided at the end 42 of the device and which adapter extends into the greater unit 46 when connected thereto. The optical adapter has a reflective material. The greater unit 46 has apertures 84 that allow light therethrough.

Alternatively, the data gathering device 80 can be arranged and configured with the side wall extending to past the light emitter(s) 74,76, and therefore the data gathering device can have one or more apertures in its side wall such that the light form the light emitters is emitted through the at least one aperture in the side wall rather than through an aperture or apertures in the greater side wall. Thus, the data gathering device can be a completely self contained device that connects directly to a greater unit or indirectly, such as via a cap or adapter device.

Light from the emitters is directed onto at least one reflector 86 of the adapter. The emitted and reflected light can be observed through the apertures 84 in the greater or side wall of the data gathering device.

It will be therefore appreciated that the adapter need not extend into a greaser. A tube section or other component, such as the data gathering device itself, having at least one aperture to observe the light through is sufficient. The red-green indications (or whatever selected colour combination of light is used) can be observed through the aperture (s) when rotating the device to obtain core sample orientation.

Thus, advantageously, when the data gathering device and core sample are recovered from down the hole, the data gathering device need not be separated from the greater in order to determine a required orientation of the core sample.

Wireless communication to a remote device, such as a hand held device, to transfer data between the data gathering device and the remote device, can also be effected by transmitting through the at least one aperture.

Embodiments of the present invention provide the advantage of a fully operating downhole tool/device without having to disconnect or disassemble any part of the tool/device from the inner tube and/or from the backend assembly or any other part of the drilling assembly that the tool/device would need to be assembled within for its normal operation.

Disconnecting or disassembling the tool/device from the backend and/or inner tube risks failure of seals at those connections and/or risks cross threading of the joining thread. Also, because those sections are threaded together with high force, it takes substantial manual force and large equipment to separate the sections.

High surrounding pressure in the drill hole means that the connecting seals between sections must function perfectly otherwise water and dirt may ingress into and damage the device. Having a tool/device that does not need to be separated from the inner tube and/or backend sections in order to determine core sample orientation and/or to gather data recorded by the device/tool means that there is less risk of equipment failure and drilling downtime, as well as reduced equipment handling time through not having to separate the sections in order to otherwise obtain core sample orientation. Known systems require end-on interrogation of the device/tool.

By providing a sealed device/tool and the facility to determine orientation of the core sample, by observing the orientation indications through one or more apertures in the side of the sealed device/tool, or by transmitting light through apertures in a side wall of a greater or other section, such as an adapter, reliability and efficiency of core sample collection and orientating is improved. Consequently operational personnel risk injury, as well as additional downtime of the drilling operation.

Without having to separate the tool/device from the inner tube and/or backend, the orientation of the core sample can be determined and the gathered information retrieved with less drilling delay and risk of equipment damage/failure.

One or more forms of the present invention relate to asynchronous time operation for core sampling. The data recording events taken by the downhole data gathering device are not synchronized in time with the communication device. That is, the communication device and the data gathering device do not commence timing from a reference time.

Preferably, the data gathering device may or may not take data samples (shots) at specific predetermined time intervals. For example the data gathering device can take a data sample every one minute with that one minute interval synchronized to the remote which would therefore 'know' when each sample is about to take place.

However, the communication device of the present invention is not synchronized to the data gathering device (the downhole survey or core orientation unit) i.e. asynchronous operation, and therefore the communication device does not know if or when a sample is being taken. Thus, obtaining an indication of core sample orientation is simplified and more efficient over known arrangements.

At the surface, the communication device 60 can signal to the data gathering device 42, 80 to activate or come out of a standby mode prior to deployment downhole. However, if preferred, the data gathering device may already be activated i.e. it is not necessary to have the data gathering device switch on from a deactivated ('turned off') state.

Alternatively, the data gathering device may be configured to activate and commence taking data samples after a predetermined period from deployment from the surface or after elapse of an activation delay timer or other delay mechanism. For example, the data gathering device may be configured at the surface to only 'wake-up' from a standby mode to an activated mode after at least a predetermined period of time has elapsed or a counter has completed a predetermined count relating to a time period delay.

Preferably, instructions for the data gathering device to take measurements/record orientation data are generated based on the time intervals and/or randomly generated time intervals.

The instructions to record data generated as a result of the regular or randomly generated time intervals may remain on-going but because the sensor(s) in the data gathering device may be shut down/deactivated so that no orientation data gets acquired during vibrations. When the vibrations stop the sensors are turned on and the time intervals instructions would then resume execution as per the time regular or random intervals.

Thus, orientation data is being measured/obtained per the time intervals being used, as preferably initiated at the beginning of the run or after a delay timer. Some data will not be recorded during the time intervals due to the fact that the sensor(s) will be off/deactivated e.g. during vibrations.

When drilling ceases, data will be taken, and may preferably continue to be taken, in accordance with the time intervals scheme initiated at the surface, and preferably may always running in the background even when the sensor(s) is/are off or deactivated (e.g. asleep).

Preferably, the data gathering device logs/records orientation related data downhole at intervals (regular or randomly generated intervals within minimum and maximum interval time limits) and also measures total lapsed survey time T.

The data gathering device can be started by a first communication device at the surface but a second, different, communication device can be used to 'mark' (to set) the point in time i.e. to commence the elapsed period of time t relating to breaking the core sample from the underlying rock and thereby be used for identifying the data set recorded immediately before that break.

To compensate for taking regular or random time period orientation measurements, which uses up battery power as the data gathering device advances downhole, a start delay can be provided.

For example, when the communication device at the surface is operated e.g. turned on, an option to set a delay time in the data gathering device may be displayed. For example, a number of between 0 to 99 might be displayed. This represents a delay in minutes. When the data gathering device is started-up and the communication device communicates the delay period to the data gathering device, the timer in the data gathering device will allow the delay period to elapse before any orientation measurements are recorded.

So, for example, if a minimum drill run on a rig is say for example 40 minutes, the user would set this number to 40 (a margin of, say, 10%-15% can be included). This means when the user initiates the communication device, it will in fact start running in 40 min less 15% e.g. in 36 min after its commanded to start running. This means for the first 36 min there will be no or little power consumption as there will be no measurements.

Once this pre-set delay time expires, the timed random or regular intervals will commence. In this way, one or more embodiments of the present invention can achieve comparable downhole tool speed and battery life as a downhole tool that has a 'sleep' mode whereby the tool would otherwise remain in a standby 'sleep' mode until drilling vibration has ceased for a period of time.

Figure 10:
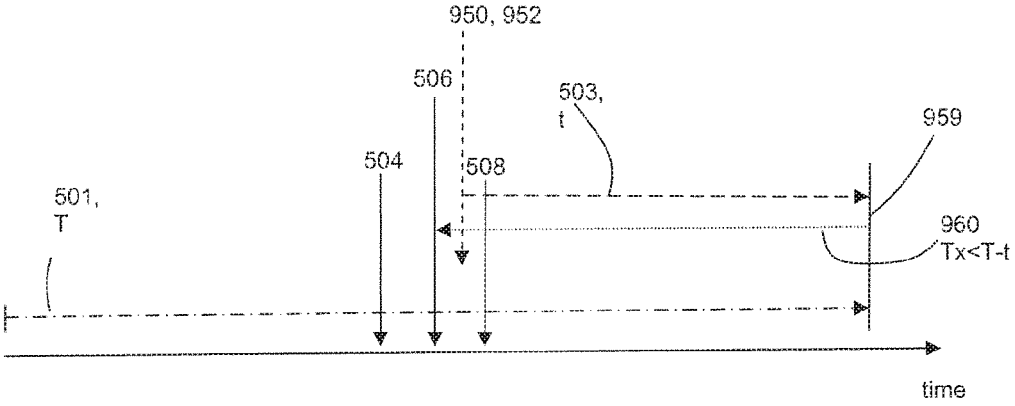
FIG. 10 shows a chart of an embodiment of the present invention.

As represented in FIG. 10, the preferred recorded orientation data can be the data recorded while drilling is ceased and closest to time Tx, where Tx is preferably less than or equal to T−t, and where T is the time recorded by the data gathering device (survey time) and t is the elapsed time recorded by the communication device that was commenced once drilling ceased and the orientation data was recorded.

It will be appreciated that the required recorded data may be at a time Tx greater than T−t i.e. if the drilling remained ceased after commencing the elapsed time and separating (breaking) the core sample from the rock was delayed while the data gathering device recorded orientation data. Thus, Tx can be greater than T−t providing no drilling activity takes place after drilling ceases and before the core is broken from the underlying rock.

Thus, with data gathering device and core tube assembly retrieved back at the surface (the core tube containing the core sample), the communication device interrogates the data gathering device to identify the recorded core orientation data closest to T−t i.e. the timer of the communication device is not synchronised to the timer of the data gathering device, and both timers are not commenced at a reference time.

The Data gathering device essentially looks back t period of time to find the orientation data recorded closest to t period of time ago.

The communication device 60 and the data gathering device 42, 80 do not require sending or exchanging time information from one to the other at setup prior to deploying the data gathering device downhole.

The communication device 60 does not mark start time and the actual start time is not needed to be recorded by or in the communication device 60.

The communication device 60 does not need to start a timer, its timer or clock (preferably a 'real time' clock) can be permanently running.

The data gathering device 42, 80 preferably does not record a start time as an initial reference time. Thus, it is not necessary to make a data gathering event (shot) in a specific period of time beyond this reference time.

Preferably, the data gathering device does not start a timer, its own internal clock is preferably always running.

No initial roll indication at the surface prior to deploying the device is required. Thus, no initial reference point is required before the device is deployed downhole of the data gathering device 42,80 is taken before lowering downhole as a reference "orientation point".

The data gathering device preferably records orientation data (takes 'shots') when it detects drilling is not occurring. That is, the data gathering device need not obtain or generate downhole data during drilling.

However, the data gathering device may be configured to record orientation data periodically, which may be regular or irregular periods of time.

For example, orientation data may be recorded by the data gathering device at regular irregular intervals of time within a known range of allowed time intervals, such as one or more of 10 s, 15 s, 20 s or 30 s intervals within a range of 1 s to 1 minute.

The time intervals may be generated by a random (time) number generator operating within the minimum and maximum allowed range. Thus, the time intervals for obtaining orientation data may be repeated (e.g. 10 s, 10 s, 10 s, 20 s, 20 s, 10 s . . . ).

Data recording events ('shots') are therefore preferably not constantly taken on a set time period. However, predetermined set time intervals may be used. That is, the data gathering device may record orientation data every time interval, preferably up until the core is broken form the underlying rock, though recordal may also continue afterwards.

For the purposes of this invention, the phrase 'during drilling' means whilst drilling (i.e. rotation of the drill bit and drill string) is actually occurring rather than the general drilling operation as a whole.

The data gathering device 42, 80 of the present invention can include at least one vibration sensor, and preferably at least one of a gravity sensor, magnetic field sensor, accelerometer, inclinometer, and preferably a combination two or more of these devices. These 'sensors' are packaged into the data gathering device which is compatible for connection with downhole tubing, greasers and other instrumentation devices.

The data gathering device is preferably powered by an onboard battery, and preferably the data gathering device is hermetically sealed to prevent ingress of water and contaminants at pressure when downhole.

The data gathering device 42, 80 in conjunction with the communication device 60 forms a system or part of a system, and preferably with any other equipment as needed.

The communication device may be incorporated in a remote controller. For example, a remote controller may be used to control or affect operation of the data gathering device.

The remote controller may include an internal timer which operates without synchronization with an internal timer of the data gathering device.

Figure 9:
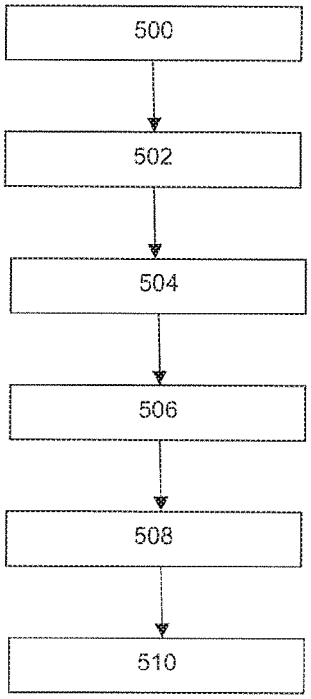
FIG. 9 is a flow chart showing steps involved in obtaining usable recorded data of downhole survey equipment for determining orientation of a core sample according to an embodiment of the present invention.
Figure 11:
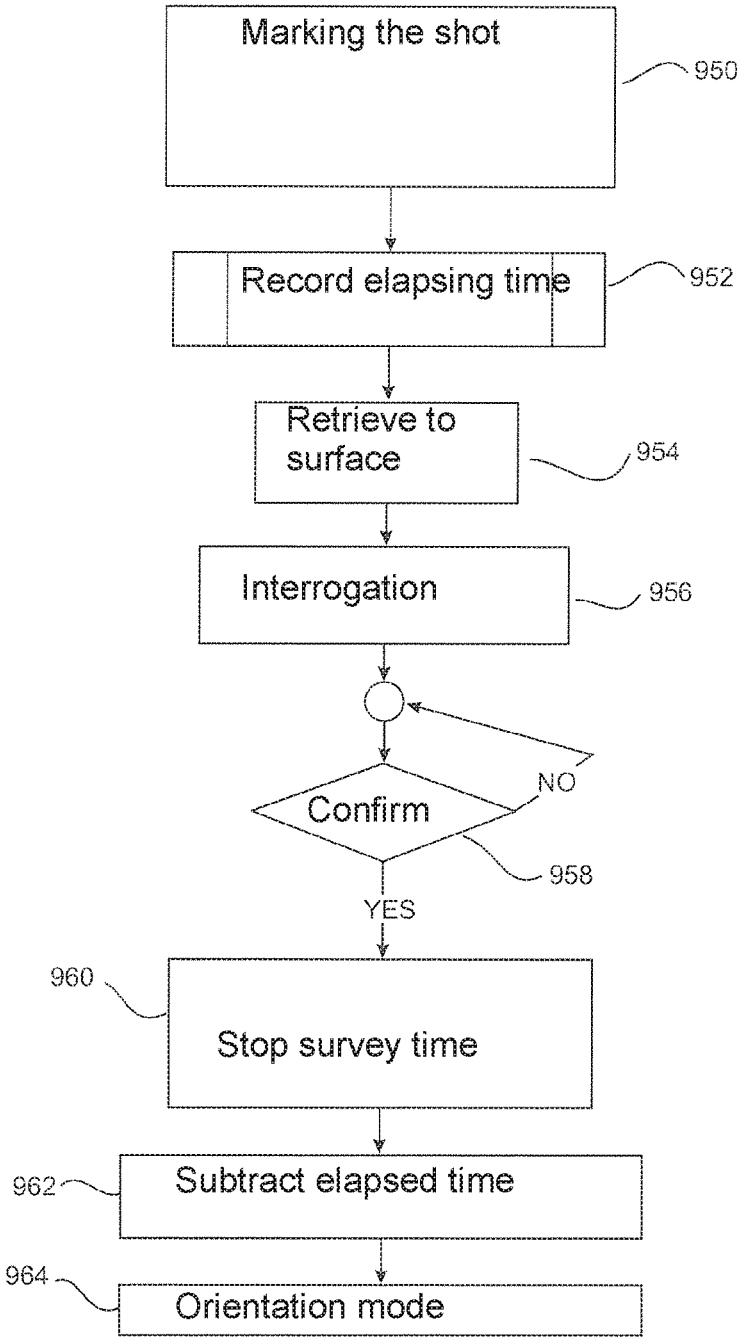
FIG. 11 shows a flow chart of selection of useable data for use in determining core sample orientation according to an embodiment of the present invention.

FIGS. 9, 10 and 11 show general schematic and flow chart operation of the system and method for the data gathering device downhole. Further operation of the system and method is continued with reference to FIG. 10 below.

The data gathering device is deployed 500 downhole. The data gathering device can be started at the surface and its timer commence 502 the survey time 501 timing at the surface, or the timer can have a delay to save power until the data gathering device is all or partway down the borehole. A timer can be a real time timer, such as a clock, or a counter.

When the core sample has being captured sufficiently in the core tube, drilling ceases 504.

During a period of no drilling 504 (drilling has ceased), the data gathering device records 506 orientation data relating to its own orientation in the borehole, and therefore, of the core sample captured in the attached core tube which core tube cannot rotate unless the data gathering device also rotates. The operator(s) at the surface wait during ceased drilling to ensure that the data gathering device records the orientation data.

The core is broken away (separated) 508 form the underlying rock to which it is attached at its base.

The core sample in the core tube and the data gathering device are retrieved 510 to the surface.

FIG. 11 shows a flow chart relating to selection of recorded orientation data once the data gathering device is retrieved to the surface.

The communication device 60 records the elapsed time t by a user marking the shot 950 i.e. commencing the timer in the handheld communication device at the surface. This is preferably either when drilling has ceased or immediately before breaking the core from the rock while drilling has ceased, or immediately after the core is broken.

However, it will be appreciated that the elapsed time can be commenced after the core is broken away from the underlying rock because the data gathering device can be programmed to identify the nearest recorded data older than the commencement of the elapsed time that occurred during no drilling.

As referenced in FIGS. 10 and 11, the communication device retains a record 952 of the elapsing time.

The data gathering device and core tube containing the core sample are retrieved 954 to the surface.

The user initiates interrogation 956 of the data gathering device.

Once the data gathering device confirms 958 receiving the interrogation command, the communication device commands halting of the survey time T 501 (stopping the data gathering device's timer) and elapsed time t (stopping the communication device's timer).

The communication device instructs the data gathering device to identify 960 the recorded orientation data from immediately before or after the commencement of the elapsed period of time going back from the end of the survey time 501 i.e. the data gathering device has to look back in time for the data recorded at or around the elapsed ago.

Thus, as shown in FIG. 10, the data gathering device subtracts 962 the elapsed time t 503 from its survey time T 501 to provide a time Tx associated with the required recorded data obtained when drilling was ceased i.e. a clean recordal.

The data gathering device, once the correct recorded orientation data is identified in its memory, goes into orientation mode 964 so that the core sample can be orientated and that orientation recorded.

Preferably, recordal of orientation data by the data gathering device is triggered on a time interval basis, this may be by the regular or random time intervals mentioned above.

Recording the orientation data may only commence once the time delay has ended. For example, the timer within the data gathering device may be running from deployment (or before) of the device into the borehole. However, the delay may prevent the device from recording orientation data until the delay has ended.

Once the delay has ended, orientation data is recorded according to the prevailing time interval sequence i.e. randomly generated time intervals or regular time intervals.

Alternatively, when vibration or other motion of the data gathering device stops downhole sufficiently, the device may resume recording orientation data according to the prevailing time interval regime or may switch to another time interval regime for sensing and recording orientation.

Preferably the delay before the data gathering device commences sensing and recording orientation data at time intervals may be at least 8 minutes, preferably 30 to 40 minutes. This allows for time for the device to travel down the borehole and reach the desired location before recording data and therefore using battery power. The delay beneficially reduces overall power consumption, such that the device can remain deployed in the field for longer than would otherwise be the case of using power continuously with recording data at intervals from commencement of deployment at the surface.

Preferably the random time intervals are selected from a range of 10 s to 30 s, more preferably from arrange of 15 s to 25 s, and more preferably within a range of 20 s to 25 s, with intervals being preferably one second intervals i.e. preferably randomly selected from 20, 21, 22, 23, 24 or 25 second time intervals.

If the 'mark' is not taken i.e. the timer at the surface not commenced, prior to breaking the core from the underlying rock, the mark can be taken very shortly after breaking the core providing no further drilling or other movement occurs. Because breaking the core is an upward (uphole) pull on the core barrel and therefore on the core sample, it is unlikely that the core sample will rotate within the core barrel relative to data gathering device (and therefore otherwise render any subsequent data recording inaccurate).

The data gathering device can therefore be setup to identify core orientation data recorded before breaking of the core sample but based on an elapsed time period commenced after breaking the core sample. The data gathering device can be instructed to identify the recorded orientation data that that was recorded before commencement of the elapsed time.

That recorded data may have been recorded also after breaking of the core sample, because of the time interval recording regime. However, if that data set was recorded while nothing was moving downhole (and has not moved since breaking the core), the data set can be trusted to be sufficiently accurate. It can be compared with one or more previous data sets, and if they concur, then can be deemed sufficiently accurate for orientation purposes. Only one of those data sets is needed and any other of them may be discarded or disregarded.

Tx may be larger than T−t if the elapsed time t is commenced after breaking the core and while no further movement has occurred downhole. If this happens, the downhole orientation data recording device is programmed to check the orientation data sets, and if two consecutive orientation sets are the same, (they are allocated to the same time stamp), the device can ignore the latest one and then check for the data set previous to those two. If that next previous is the same as the earliest of the two orientation data sets, again the latest one is ignored or deleted, until the next previous orientation data set is different to the next later one of those two.

For marks taken after breaking the core, when the two adjacent data sets are different, the device then uses that the earliest of the two as the data set to use for orientation (the earliest Tx).

One or more embodiments of the present invention will be further understood from the following description.

Operation of the data gathering device to commence recording orientation data is preferably initiated at the surface, and device then deployed into the borehole. Commencement of recording orientation data can be delayed, so as to save battery power by avoiding taking unnecessary or unusable orientation measurements whilst the device is progressing down the borehole. Orientation measurement immediately before or after breaking the core sample from the underlying rock is/are required.

The data gathering device can therefore have a delay preventing recording of orientation data until the delay ends.

The data gathering device can take orientation measurements periodically, such as at random or regular periods of time, and record one or more of those measurements.

Preferably the device can be in a sleep mode, change to a power-up (wake-up) mode and then take a measurement, and re-enter sleep each interval.

If two or more consecutive orientation measurements are the same, the device can ignore, not record or delete from memory unnecessary repeat measurements and only retain one of the repeat measurements, preferably being the first of the identical measurements.

Each recorded measurement of orientation is tagged or 'time stamped', preferably relative to the timer running in the device i.e. the recorded orientation data is given a time stamp Tx, where x is the particular time within the survey timeframe running in the device. Thus, Tx is the time since the survey time T commenced that that orientation data set was recorded. Tx can be a real time or cumulative time since commencement of the survey time T. Thus, the data gathering device can have a real time clock type timer or a 'start-stop' or counter or stopwatch type timer.

When drilling ceases and the core is to be broken from the underlying rock (because there is sufficient core sample in the core barrel), a 'mark' is taken. This commences an elapsed time t at the surface.

Figure 12:
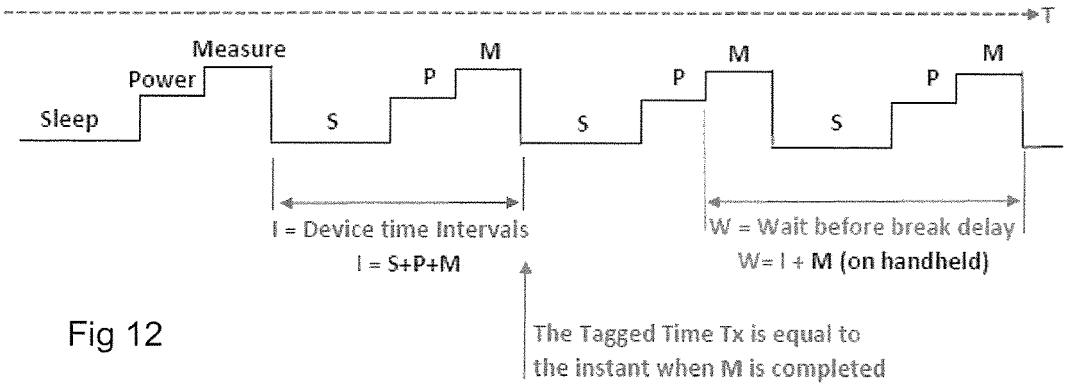
FIG. 12 shows an example of the components making up consecutive time intervals and a 'wait' or delay period prior to core break, according to at least one embodiment of the present invention.

A time interval of the data gathering device can include three durations, being a sleep time, sensor power up time and a sensor measuring time. Hence, as shown in the exemplary embodiment of FIG. 12, the interval (I)=Sleep time (S)+Power up time+Measurement time (M), or I=S+P+M for short.

For regular time intervals, S, P and M can be, and preferably are, substantially the same for all intervals.

For random or irregular time intervals, the Sleep time (S) can vary from interval to interval or be S time can be repeated on interval to the next on a random basis i.e. two or three S times can be the same consecutively, but the next one may be different etc. Random or irregular time intervals can be within a minimum and maximum time interval range. For example, the minimum interval may be 1 second and the maximum 10 seconds, with the actual time interval varying between the two extremes on a random basis, such as by using a random number generator or counter.

When an operator is ready to 'mark' or 'take a shot' before the core break, the operator can be given a prompt to wait for a period of time, say wait time W, such as by a display and/or sound from the communication device.

When the data gathering device records an orientation measurement, the measurement recordal is then tagged by the lapse timer T already running of the data gathering device, where Tx is the is the time instant the respective measurement recordal at time M is completed.

Wait time W is to be equal to or greater than the largest I+M.

If two or more consecutive measurements are equal, they are all tagged against time Tx being the Tx that is respective to the first M in that group of identical consecutive measurements.

In the event that the wait time period W includes the completion of 2×M periods, the Tx tagged during W will be the larger (or later) of the two, as further described below.

Marking Before the Break—Regular Time Intervals

The following embodiment is described with reference to the example in FIG. 13.

Presuming regular time intervals I between orientation data measurements, there can now be a time delay W from commencing the elapsed time t. This time delay should be at least as long as (I) a time interval between taking orientation measurements plus the time to actually measure an orientation.

For example, W should be at least as long as the sleep time S, power-up P time and measurement M time plus one measurement M time, to ensure that the data gathering device records at least one orientation data set while drilling is ceased.

After the delay W has elapsed, the core can be broken from the underlying rock. Thus, the end of the delay time W can be used as a prompt to break the core. An operator at the surface can be given an indication, such as by the communication device 60.

A time interval I has sleep (S), power (P) and Measure (M) portions. Sleep (S) is the period of the interval when the data gathering device is in sleep mode, thereby saving power. Power (P) mode occurs when the data gathering device comes out of sleep mode ready to take a measurement at M. In one or more embodiments, each interval I includes these portions S, P, M.

As time progresses (T) time Tx relating to recorded orientation data of interest can be identified as the 'tagged' time and is equal to the instant when measurement (M) is completed.

At the surface, a delay or wait period W includes one full interval (S, P & M) plus the previous measurement period. This ensures that at least one good measurement is taken while the device is out of sleep mode, powered up and measuring while drilling is ceased and before the core break is made.

Having then been retrieved back to the surface, the data gathering device is interrogated by the communication device, and at the same time both timers stop (survey time T and elapsed time t stop).

The required recorded orientation data Tx is identified as the largest Tx value<T−(t−W) i.e. the oldest Tx in time from commencement of T after taking the mark and before or by the end of the delay (waiting time) time value.

Alternatively, if the elapsed time t commences at the end of the delay period W from taking the mark (rather than commencing at the start of taking the mark), the required recorded orientation data is identified as the smallest Tx value >T−(t+W) or the largest Tx value<T−t.

Thus t can commence W delay time after taking the mark. As above, W delay time is the total time of one complete interval I plus a measurement M time e.g. of the next adjacent interval.

The mark can be commenced by an operator using a device at the surface, such as a handheld communication device 60 that will communicate with the data gathering device when it is returned to the surface. That communication will simultaneously halt both the survey time T in the data gathering device and the elapsed time tin the communication device.

Time is shown on the vertical scale. Drilling ceases just after time 4.15. A 'mark' is taken at the surface which starts a timer in the communication device 60 and commences the elapsed time t. From taking the mark, a wait time W passes until wait end T−(t−W) at 5.20.

The core is subsequently broken while drilling continues to be ceased. The core is broken at approximately 5.45 in the embodiment shown. The time Tx of interest is the overall time less the elapsed time since the mark was taken during ceased drilling less allowance for the weight time to ensure the data has recorded during ceased drilling but before break of the core. This ensures identification of the largest Tx i.e. immediately before the end of the weight time W.

Regular time intervals can mean that all intervals have the same pre-set I and the same S, P and M values. Tx can be tagged against the completion of each M in the device.

Tagged in this specification means associating two or more measurements or values with each other. For example, tagging Tx to an M value means associating the measurement time Tx is associated with a particular orientation measurement at an M.

For example, if the regular intervals are 30 seconds, then the first interval T1 is 30 s, then T2 is 60 s and T3 is 90 s etc. and a separate orientation measurement is tagged against these times.

However, if, say, T5 to T0 respective consecutive measurements are all equal, then the measurement will be tagged to T5. Consequently, the next different orientation measurement value will be tagged against T6 at 5 mins 30 s and not 3 mins.

Therefore, the present invention includes the system and method knowing that equal intervals with equal measurements have the same measurement tagged to one time Tx.

In use, for example, the data gathering device is put into running mode at the surface or automatically commences running mode when downhole. The timer in the data gathering device commences or notes a start time from an already running timer. This commences the (regular or irregular/random) interval timing depending on the embodiment/application in use. Time interval I can be regular or irregular.

When drilling ceases, the operator at the surface initiates the handheld communication device to commence an elapsed time. The timer in the communication device may be started or already running and the operator marks a start time for the elapsed time.

Figure 13:
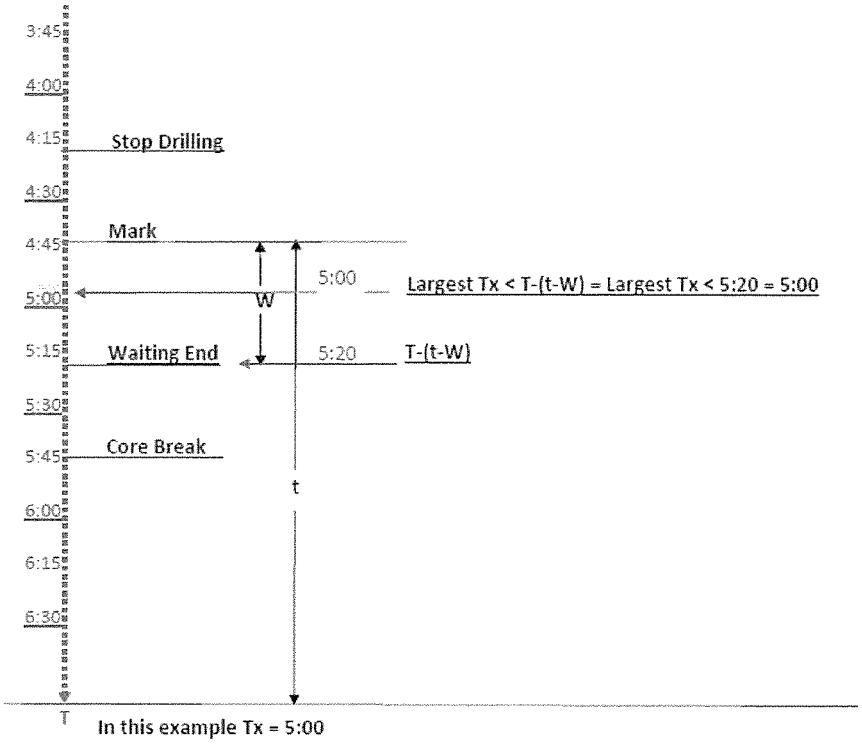
FIG. 13 shows an example of finding the recorded orientation data set of interest for core orientation with the use of regular time intervals for orientation measurements and the mark being taken before the core break, according to at least one embodiment of the present invention.

Assuming, say, a measurement time M of 5 seconds, the operator is prompted to wait for 35 s, the wait time W being I+M (30+5), until 5.20 e.g. shown in the example in FIG. 13.

The operator can then break the core and retrieve it to the surface. Say, at T=5.45 as an example.

At the surface, the communication device communicates with the data gathering device and both timers preferably cease or mark a stop time. Total elapsed time from the communication device less the wait time W will be identified in the data gathering device i.e. t−W. The data gathering device will then subtract the elapsed time less the wait time from the total time i.e. T=T−(t−W). In the example shown in FIG. 13, T−(t−W) is time 5.20.

The Tx associated with the orientation recordal before the core break is the largest Tx less than T−(t−W), in the example given, the largest Tx less than 5.20, being Tx=5.00. The data gathering device can then provide the orientation data relating to the identified Tx e.g. at Tx=5.00.

Marking after the Break—Regular Time Intervals

If an operator omits to take the 'mark' i.e. omits to commence the elapsed time timer for the elapsed time t at the surface, before the core sample is broken from the underlying rock, the mark can still be taken after breaking the core providing no further movement occurs.

In this scenario, no delay time W is required i.e. W=0. However, the operator pauses for a minimum period of no movement of the drill and core tube after breaking the core of typically not less than 30 s. This allows at least one further orientation data at Tx to be recorded.

Presume drilling has ceased and the operator breaks the core sample after some delay but does not commence the elapsed time t, the operator can subsequently commence elapsed time after the core break and, back at the surface, the data gathering device and the communication device communicate and stop the survey time T and elapsed time t.

All orientation data shots after the core break are expected to be the same because the core, core tube and data gathering device do not move relative to one another if there is no further downhole activity at that time. All but one of those orientation data shots can be disregarded or deleted.

At the surface, the data gathering device will provide the recorded orientation data set that was recorded prior to the earliest of the post core orientation data set i.e. the orientation data set recorded before the core break and while drilling was ceased.

The required recorded orientation data set is therefore identified as the second largest Tx value<T−t, i.e. the orientation data set expected to be between drilling ceasing and the core break.

If the 'mark' (commencing the elapsed time t at the surface) is taken 'too late' i.e. after the core break, the second largest data recording event Tx can be used as the measurement for identifying the relevant core orientation data.

This methodology and operation is used if the operator forgot or otherwise missed taking the mark/shot before breaking the core, if no movement (drilling) has occurred since the core break and a pause was made before breaking the core sufficient for the data gathering device to be still and record orientation data.

Figure 14:
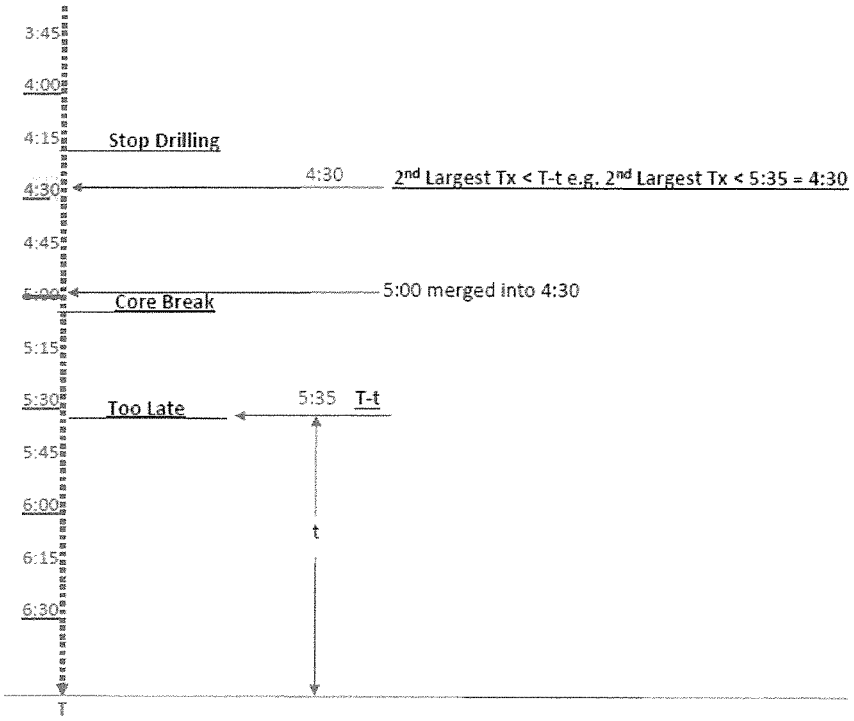
FIG. 14 shows an example of finding the recorded orientation data set of interest for core orientation with the use of regular time intervals for orientation measurements and the mark being taken after the core break, according to at least one embodiment of the present invention.

The exemplary embodiment is shown in FIG. 14 for identifying suitable recorded orientation data from before the core break even after the 'mark' is taken after the core break.

Marking Using Random Time Intervals and Before the Core Break

Figure 15:
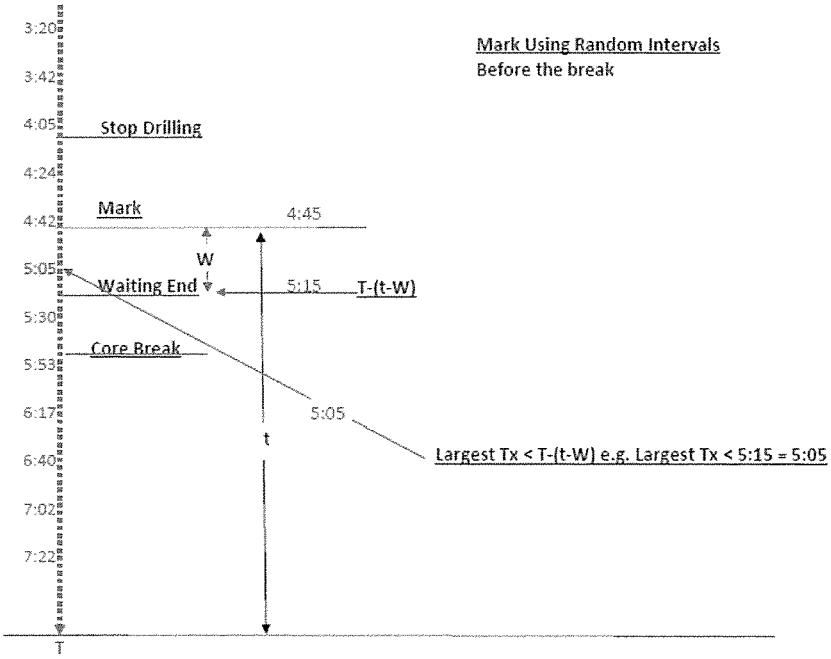
FIG. 15 shows an example of finding the recorded orientation data set of interest for core orientation with the use of random or irregular time intervals for orientation measurements and the mark being taken before the core break, according to at least one embodiment of the present invention.

Refer to the exemplary embodiment shown in FIG. 15.

For random time intervals, the total time of an interval I need not be the same for each interval for orientation measurements.

Particularly the sleep (standby) mode can be longer or shorter from one interval to the next.

Some intervals may be the same, decided by a random number generator selecting the intervals from a range of allowed intervals, as discussed above.

The mark is taken after drilling is ceased. This can commence the elapsed time t and the delay period (waiting time) W to ensure the data gathering device takes another orientation measurement. The core is then broken after the waiting period W ends.

At the surface, the communication device communicates with the data gathering device and both timers T and t stop. The orientation data can be the set with the largest Tx value<T−(t−W).

If random i.e. unpredicted time intervals are used (which can be truly random or preferably randomised set time divisions within a known overall range of minimum and maximum time values), and the 'mark' is taken before the core break to commence the elapsed time t, as with the embodiment described in relation to FIG. 13, the relevant recorded orientation data is before the end of the wait period W i.e. before T−(t−W).

Marking Using Random Time Intervals and after the Core Break

Figure 16:
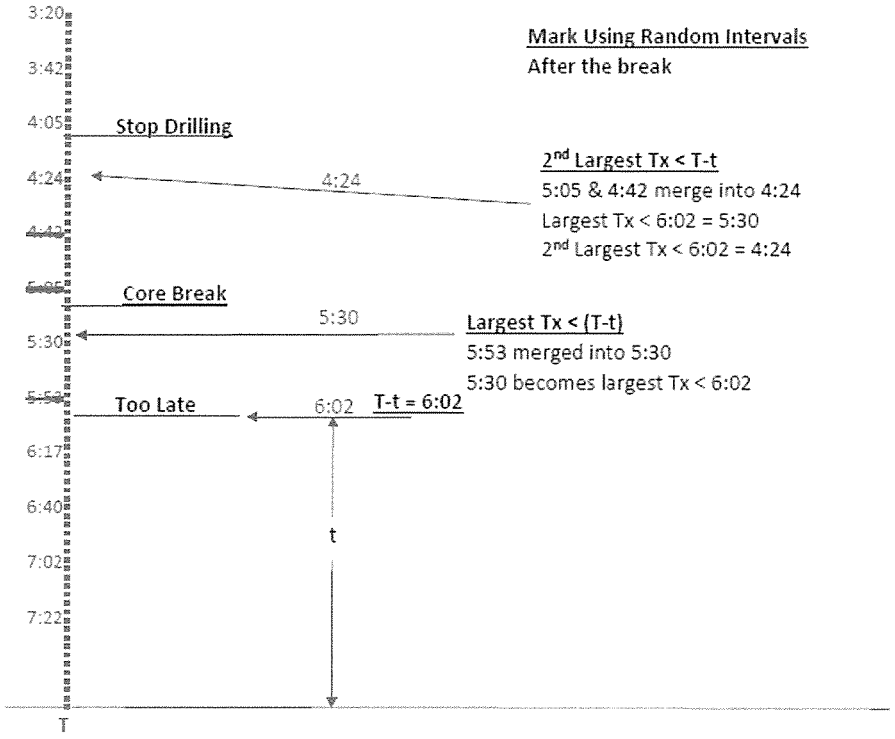
FIG. 16 shows an example of finding the recorded orientation data set of interest for core orientation with the use of random or irregular time intervals for orientation measurements and the mark being taken after the core break, according to at least one embodiment of the present invention.

Refer to the exemplary embodiment shown in FIG. 16.

If the mark is taken after the core break i.e. the elapsed time t commences after the core is broken, the recorded orientation data set of interest is preferably the 2nd largest Tx value<(T−t), as described in relation to the embodiment and example given in FIG. 16.

Preferably, the wait period during random time intervals is sleep time plus power up time plus measurement time plus measurement time, where the sleep time is the largest random sleep time value allowed.

The invention claimed is:

1. A method of obtaining orientation data for a rock core sample obtained by drilling, the method including:

advancing a data gathering device into a borehole from a surface, the data gathering device having a timer, the timer commencing timing a time period before the core sample is separated from a subsurface rock formation, ceasing drilling;

recording at least a first set of orientation data within the data gathering device at time intervals wherein the time intervals are irregular, random or selected at random from a predetermined range of time intervals, wherein generating the time intervals includes using a random number generator, commencing an elapsed time at the surface;

separating the core sample from the subsurface rock formation before or after commencing the elapsed time;

returning the core sample and the data gathering device to the surface;

stopping the elapsed time and the time period recorded by the data gathering device; and identifying recorded orientation data from the at least a first set of orientation data of time value (Tx) being a time value less than T−(t−W), where T is time recorded by the data gathering device and t is the elapsed time in the communication device and W is a delay period during which the data gathering device records an orientation measurement.

2. The method of claim 1, further including ceasing recording the orientation data at the time intervals during one or more periods of drilling and recording the orientation data at the time intervals during one or more periods of no drilling.

3. The method of claim 1, wherein each said time interval is between a minimum of 1 second and a maximum of 60 seconds.

4. The method of claim 1, wherein recording the at least a first set of orientation data is while drilling is ceased and after commencement of the elapsed time but before the core is separated from the subsurface rock formation.

5. The method of claim 4, further including recording the at least a first set of orientation data after commencement of the elapsed time.

6. The method of claim 4, further including commencing the delay period W commensurate with or after commencement of the elapsed time.

7. The method of claim 1, further including recording the at least a first set of orientation data while drilling is ceased and before commencement of the elapsed time but before the core is separated from the subsurface rock formation.

8. The method of claim 7, further including commencing the delay period prior to commencing the elapsed time, the wait time ensuring recording of the at least a first set of orientation data.

9. The method of claim 7, further including recording the at least a first set of orientation data before commencing the elapsed time.

10. The method of claim 1, further including recording the at least a first set of orientation data while drilling is ceased and after separation of the core from the subsurface rock formation but before commencing the elapsed time.

11. The method of claim 10, further including providing the delay period after separating the core before commencing the elapsed time, the delay period ensuring recordal of post core separation orientation data, and the required orientation data being orientation data recorded before the post core orientation data but while drilling was ceased.

12. The method of claim 1, wherein the data gathering device is in a standby or sleep mode while vibrations from drilling are detected by the data gathering device.

13. The method of claim 1, wherein at least one said irregular time interval includes a sleep time (S), a sensor power up time (P) and a sensor measuring time (M).

14. The method of claim 13, wherein the delay period (W) is at least as long as a sum of the sleep time, the power up time and the measurement time.

15. A system for use in determining orientation of a core sample obtained by drilling from a surface aboveground into a subsurface body, the system including:

a data gathering device configured to record orientation data downhole at time intervals, the orientation data relating to orientation of the core sample, wherein the data gathering device is configured to make periodic orientation data recordals at irregular time or random time intervals, or selected at random from a predetermined range of time intervals, wherein the time intervals are determined by a random number generator, and the data gathering device including a first timer configured to provide a survey time, and a communication device and a second timer located at the surface, the second timer configured to provide an elapsed time value, and the data gathering device including processing means which is configured to identify required recorded orientation data at a time value (Tx) being a time value less than T−(t−W), or for the elapsed time commencing after a delay period W, identify the required recorded orientation data being at a time value (Tx) less than T−(t+W) or the largest Tx value<T−t, where T is time recorded by the data gathering device and t is the elapsed time in the communication device and W is the delay period during which the data gathering device records an orientation measurement.

16. The system of claim 15, wherein the data gathering device's timer is configured to provide a timestamp for recorded data events.

17. The system of claim 15, wherein the data gathering device is configured to record the orientation data at irregular time intervals within predetermined maximum and minimum time interval limits.

18. The system of claim 15, wherein the data gathering device's timer is configured to delay commencing timing after the data gathering device is deployed downhole.

19. The system of claim 15, wherein a timing commencement delay is preset in the data gathering device.

20. The system of claim 15, wherein the data gathering device includes at least one of a sleep time mode, a power up time mode, and a measurement time mode.

21. A method of obtaining orientation data for a rock core sample obtained by drilling, the method including:

advancing a data gathering device into a borehole from a surface, the data gathering device having a timer, the timer commencing timing a time period before the core sample is separated from a subsurface rock formation, ceasing drilling;

recording at least a first set of orientation data within the data gathering device at time intervals while drilling is ceased, commencing a delay period W at the surface, the delay period being at least as long as the longest time interval of the time intervals, commencing an elapsed time at the surface commensurate with commencing the delay period;

separating the core sample from the subsurface rock formation before or after commencing the elapsed time and the delay period;

returning the core sample and the data gathering device to the surface;

stopping the elapsed time and the time period recorded by the data gathering device; and, identifying the recorded orientation data of the at least a first set of orientation data being at a time value (Tx) less than T−(t−W) or Tx being between T−t and T−(t−W) or being the smallest Tx value≥T−t, where T is time recorded by the data gathering device, t is the elapsed time in the communication device and W is the delay period during which the data gathering device records an orientation measurement.

22. The method of claim 21, further including ceasing recording the orientation data at the time intervals during one or more periods of drilling and recording the orientation data at the time intervals during one or more periods of no drilling.

23. The method of claim 21, further including recording the orientation data with the time intervals being irregular, random or selected at random from a predetermined range of time intervals.

24. The method of claim 21, wherein each said time interval is between a minimum of 1 second and a maximum of 60 seconds.

25. The method of claim 21, wherein recording the orientation data of the at least a first set of orientation data is while drilling is ceased and after commencement of the elapsed time but before the core is separated from the subsurface rock formation.

26. The method of claim 21, further including recording the at least a first set of orientation data after commencement of the elapsed time.

27. The method of claim 21, further including commencing the delay period W commensurate with of the elapsed time.

28. The method of claim 21, further including recording the at least a first set of orientation data while drilling is ceased and before commencement of the elapsed time but before the core is separated from the subsurface rock formation.

29. The method of claim 28, further including recording the at least a first set of orientation data before commencing the elapsed time.

30. The method of claim 21, further including recording the at least a first set of orientation data while drilling is ceased and after separation of the core from the subsurface rock formation but before commencing the elapsed time.

31. The method of claim 30, further including providing the delay period after separating the core, the delay period ensuring recordal of post core separation orientation data, and the required orientation data being orientation data recorded before the post core orientation data but while drilling was ceased.

32. A method of obtaining orientation data for a rock core sample obtained by drilling, the method including:

advancing a data gathering device into a borehole from a surface, the data gathering device having a timer, the timer commencing timing a time period before the core sample is separated from a subsurface rock formation, ceasing drilling;

recording at least a first set of orientation data within the data gathering device at time intervals while drilling is ceased, commencing an elapsed time at the surface;

separating the core sample from the subsurface rock formation before or after commencing the elapsed time;

returning the core sample and the data gathering device to the surface;

stopping the elapsed time and the time period recorded by the data gathering device; and identifying recorded orientation data from the at least a first set of orientation data at a time value (Tx) being a time value less than T−(t−W), where T is time recorded by the data gathering device and t is the elapsed time in the communication device and W is a delay period during which the data gathering device records an orientation measurement; and wherein the delay period is at least as long as a sum of a sleep time, a power up time and a measurement time; and wherein the data gathering device is in a standby or sleep mode while vibrations from drilling are detected by the data gathering device.

33. A method of obtaining orientation data for a rock core sample obtained by drilling, the method including:

advancing a data gathering device into a borehole from a surface, the data gathering device having a timer, the timer commencing timing a time period before the core sample is separated from a subsurface rock formation, ceasing drilling;

recording at least a first set of orientation data within the data gathering device at time intervals, wherein the time intervals include irregular time intervals;

commencing an elapsed time at the surface;

separating the core sample from the subsurface rock formation before or after commencing the elapsed time;

returning the core sample and the data gathering device to the surface;

stopping the elapsed time and the time period recorded by the data gathering device; and identifying recorded orientation data from the at least a first set of orientation data of time value (Tx) being a time value less than T−(t−W), where T is time recorded by the data gathering device and t is the elapsed time in the communication device and W is a delay period during which the data gathering device records an orientation measurement;

wherein at least one said irregular time interval includes a sleep time (S), a sensor power up time (P) and a sensor measuring time (M), wherein the delay period (W) is at least as long as a sum of the sleep time, the sensor power up time and the sensor measurement time.

* * * * *